US006158053A

United States Patent [19]

Wang

[11] Patent Number: 6,158,053

[45] Date of Patent: Dec. 12, 2000

[54] HEADWEAR WITH A ONE-PIECE CROWN PORTION

[76] Inventor: Wen-Ching Wang, No.15, Lane Fu-Chia, Chen-Nan Rd., Sha-Lu Chen, Taichung Hsien, Taiwan

[21] Appl. No.: 09/411,280

[22] Filed: Oct. 4, 1999

[51] Int. Cl.[7] ..... A42B 1/00

[52] U.S. Cl. ..... 2/175.1; 2/195.1

[58] Field of Search ..... 2/175.1, 175.5, 2/425, 195.1, 171

[56] References Cited

U.S. PATENT DOCUMENTS 2,398,561 4/1946 Ruggerio ..... 2/175.1
5,226,180 7/1993 Leach ..... 2/411
5,239,704 8/1993 Cornelio ..... 2/195.2
5,826,279 10/1998 Tencer ..... 2/181
5,996,125 12/1999 Garzone ..... 2/410

*Primary Examiner*—Bibhu Mohanty
*Attorney, Agent, or Firm*—Lackenbach Siegel

[57] ABSTRACT

A headwear includes a crown portion and a brim connected to the crown portion. The crown portion is formed as a one-piece molded body which is flexible while having a measure of rigidity to maintain the shape of the crown portion. The molded body is made of an elastomeric material, and has a looped marginal end. The brim is connected to the looped marginal end.

5 Claims, 9 Drawing Sheets

HEADWEAR WITH A ONE-PIECE CROWN PORTION

BACKGROUND OF THE INVENTION

1. Field of the Invention

This invention relates to a headwear, more particularly to a headwear which can be made by a relatively simple manufacturing process.

2. Description of the Related Art

FIG. 1 illustrates a first conventional headwear 10 which includes a crown portion 11 formed by sewing together three pieces of cloth 111. The crown portion 11 is then sewn to a brim 12 to complete the headwear 10. FIG. 2 illustrates a second conventional headwear 20 which includes a crown portion 21 formed by sewing together six pieces of cloth 211. The crown portion 21 is then sewn to a brim 22 to form the headwear 10. FIG. 3 illustrates a third conventional headwear 30 which includes a crown portion 31 and an annular brim 32. The crown portion 31 is formed by sewing a circular top portion 311 to an annular rim portion 312. The top portion 311 and the rim portion 312 are made from pieces of fabric. The crown portion 31 is then sewn to a brim 32 to form the headwear 30.

The conventional headwear 10, 20, 30 suffer from the following drawbacks:

(1) During the manufacture of the crown portions 11, 21, 31 of the conventional headwear 10, 20, 30, at least two stitching procedures are required for sewing together the constituting parts of the crown portions 11, 21, 31. This complicates the manufacturing process, and thus increases the manufacturing costs.

(2) Since the crown portions 11, 21, 31 of the headwear 10, 20, 30 have curved surfaces, and are made of fabric, it is difficult to provide patterns on the crown portions 11, 21, 31 by printing. Therefore, when it is desired to provide a pattern on the headwear, the pattern is generally formed by embroidering, knitting, weaving or the like, and is then attached on the headwear via machine stitching or manual stitching, or by means of an adhesive. Since additional procedures are required, the manufacturing cost is raised.

(3) Since the crown portions 11, 21, 31 are made of fabric, dirt or stains can easily attach thereon. Moreover, the crown portions 11, 21, 31 are susceptible to wrinkling and shrinking after washing.

(4) In order for the crown portion 11, 21, 31 to maintain its shape, additional treatment of the crown portion 11, 21, 31 is required during the manufacture of the headwear 10, 20, 30. However, the treatment is effective only until the headwear 10, 20, 30 is washed.

SUMMARY OF THE INVENTION

Therefore, the main object of the present invention is to provide a headwear which is relatively easy to manufacture and which solves the aforementioned problems.

Accordingly, the headwear of the present invention includes a crown portion and a brim connected to the crown portion. The crown portion is formed as a one-piece molded body which is flexible while having a measure of rigidity to maintain the shape of the crown portion. The molded body is made of an elastomeric material, and has a looped marginal end. The brim is connected to the looped marginal end.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
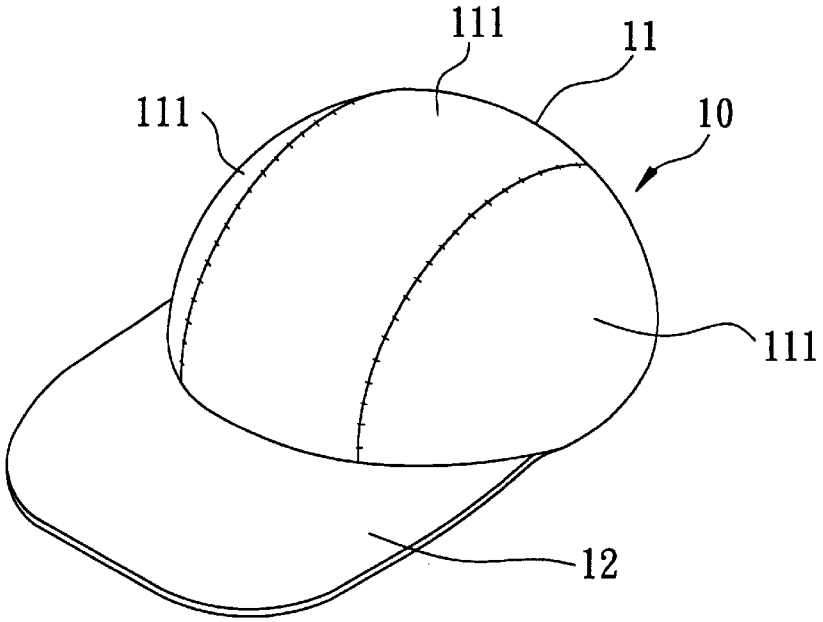
FIG. 1 PRIOR ART
FIG. 1 is a perspective view of a first conventional headwear.
Figure 2:
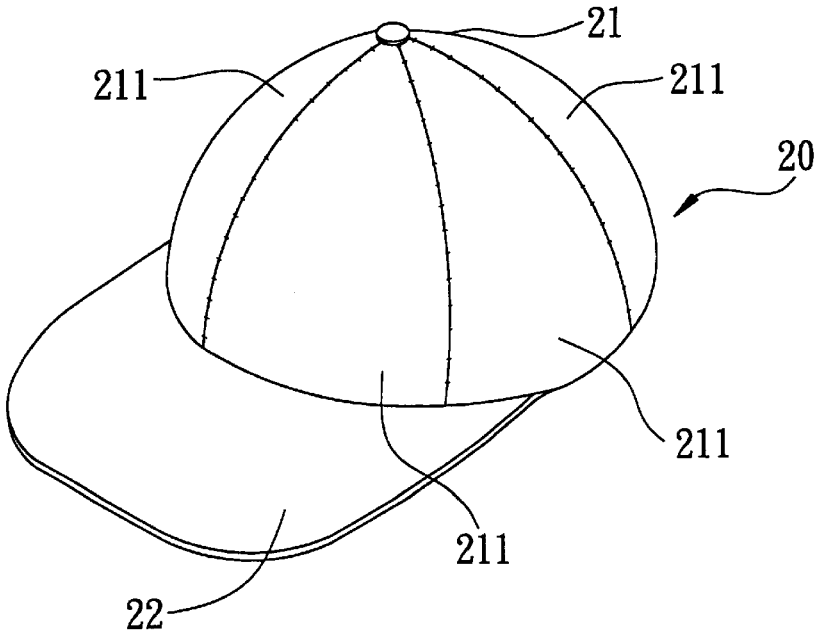
FIG. 2 PRIOR ART
FIG. 2 is a perspective view of a second conventional headwear.
Figure 3:
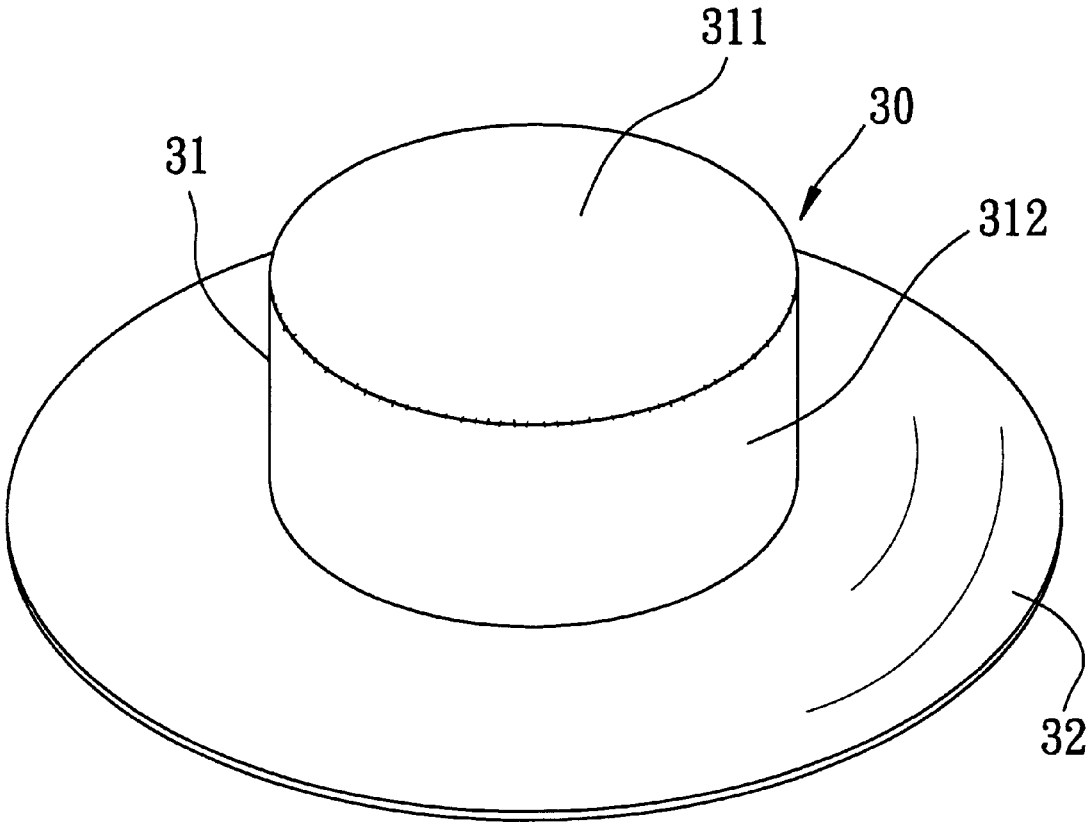
FIG. 3 PRIOR ART
FIG. 3 is a perspective view of a third conventional headwear.
Figure 4:
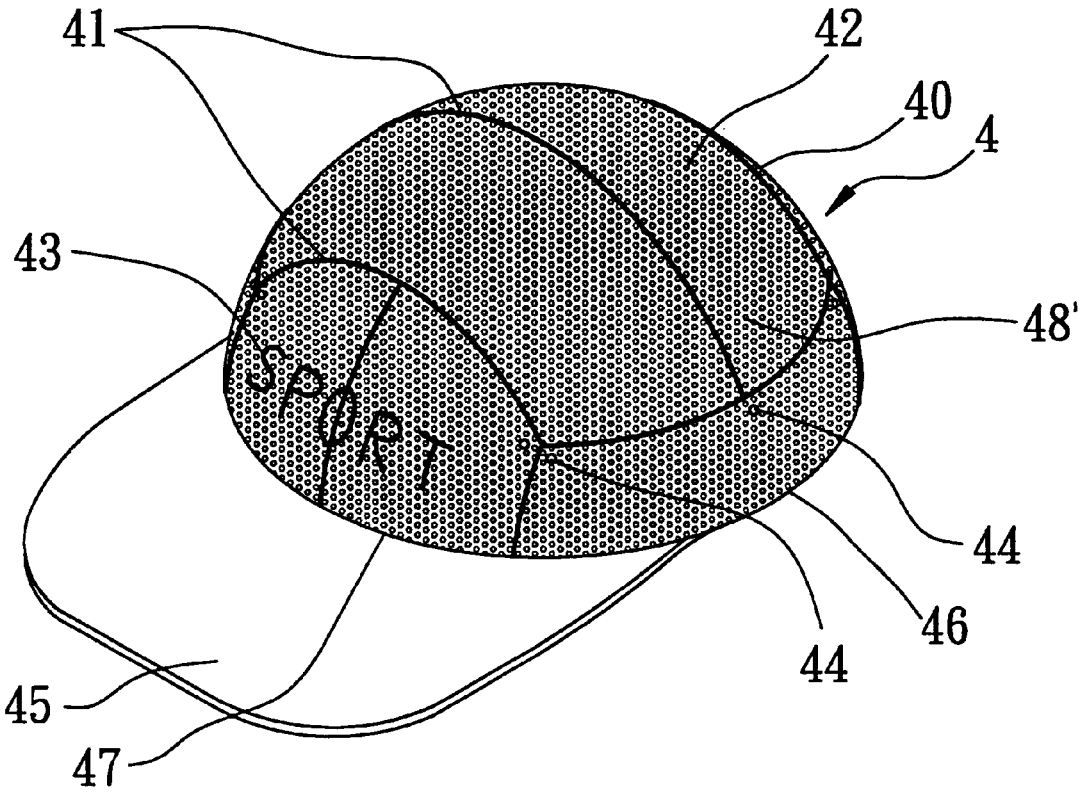
FIG. 4 is a perspective view of a first preferred embodiment of the headwear of the present invention.
Figure 5:
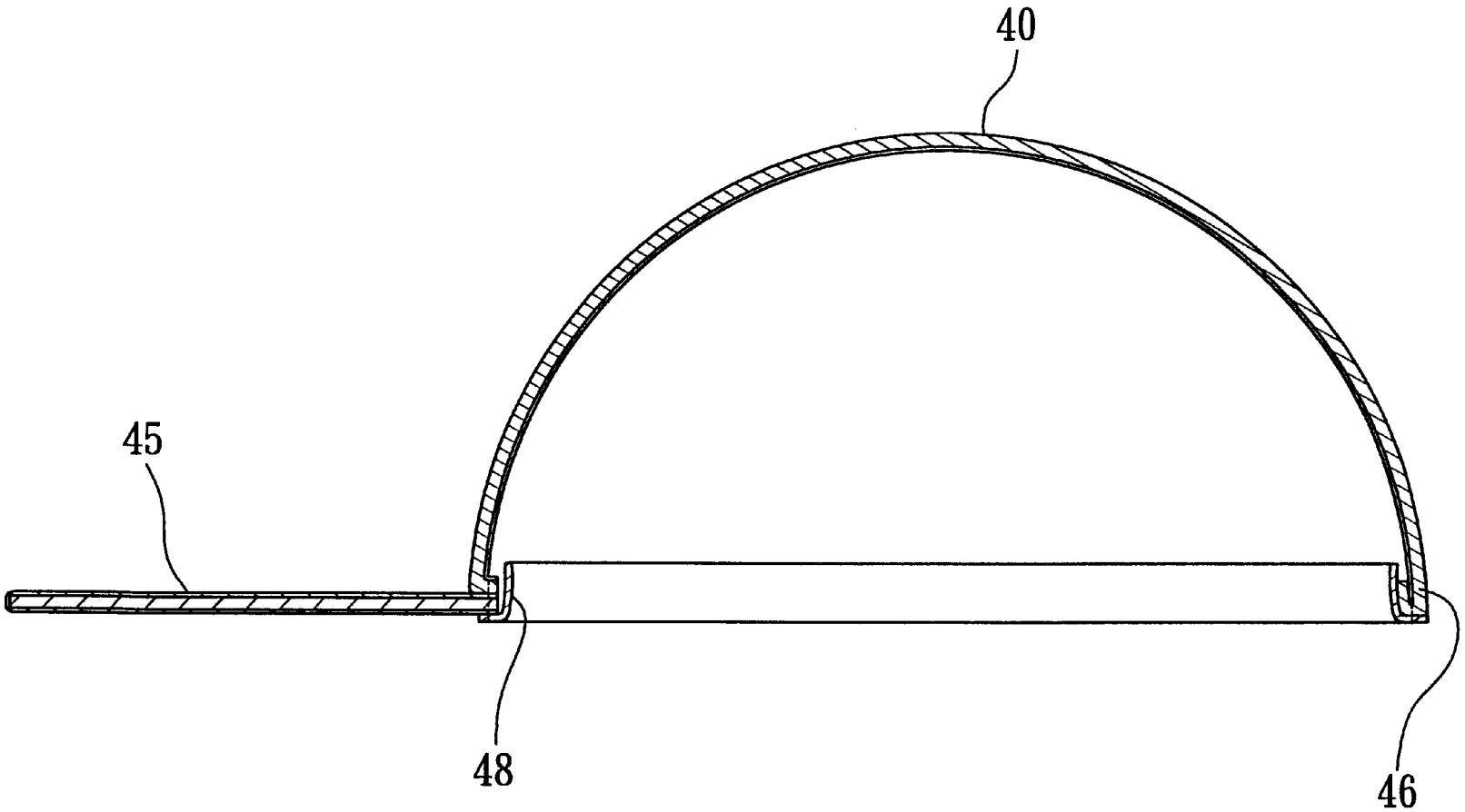
FIG. 5 is a cross-sectional view of the first preferred embodiment.

Referring to FIGS. 4 and 5, the first preferred embodiment of the headwear 4 of the present invention is shown to include a crown portion 40 and a brim 45 connected to the crown portion 40. The crown portion 40 is a one-piece molded body made of an elastomeric material, such as rubber, and made by an injection molding process, blow molding, compression molding, or centrifugal casting, etc. The crown portion 40 is flexible, while having a measure of rigidity to maintain the shape thereof. In the present embodiment, the crown portion 40 has a hemispherical shape with a annular head encircling end 46 and a convex outer surface 48'. During manufacture, the crown portion 40 is formed by a process for forming a dodge ball. The outer surface 48' of the crown portion 40 is formed with raised and indented pattern parts, such as protrusions 42 and grooves 41, so that the crown portion 40 presents an image similar to a dodge ball. A pattern 43, such as in the form of written characters, is formed on the outer surface 48' of the crown portion 40 by printing directly on the molded body. The crown portion 40 further has a plurality of vent holes 44 formed through the molded body. After formation of the crown portion 40, the brim 45 is connected to the annular head encircling end 46 of the crown portion 40 by stitching such that a stitched seam 47 is formed between the brim 45 and the crown portion 40 to interconnect the same. A protective band 48 is sewn to the head end 46 of the crown portion 40, and extends along the length of the head end 46. The protective band 48 has a width sufficient to cover the stitched seam 47 so as to prevent the head of the user from contacting directly the stitched seam 47. The protective band 48 is made of a fabric material.

Figure 6:
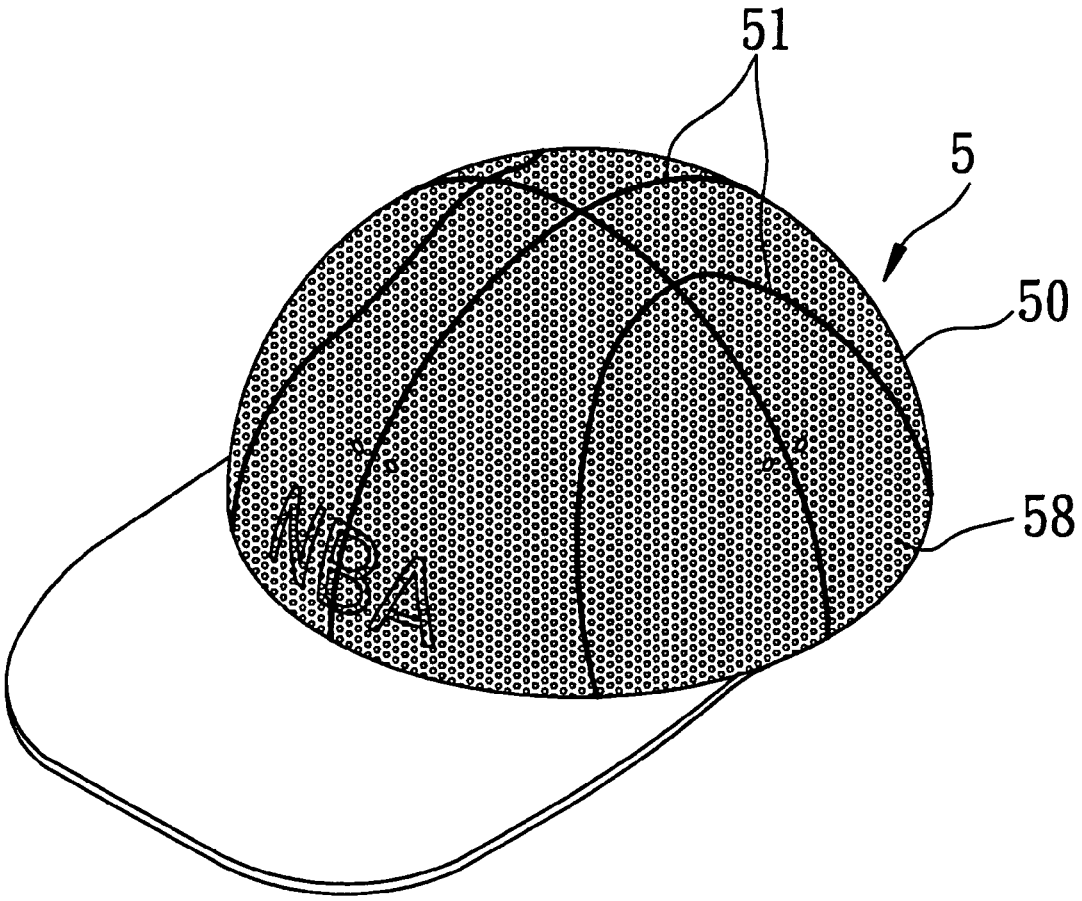
FIG. 6 is a perspective view of a second preferred embodiment of the headwear of the present invention.

Referring to FIG. 6, the second preferred embodiment of the headwear 5 of the present invention is made by a process generally similar to that of the previous embodiment, except that the grooves 51 formed on the outer surface 58 of the crown portion 50 are arranged in a different manner to present an image of a basketball.

Figure 7:
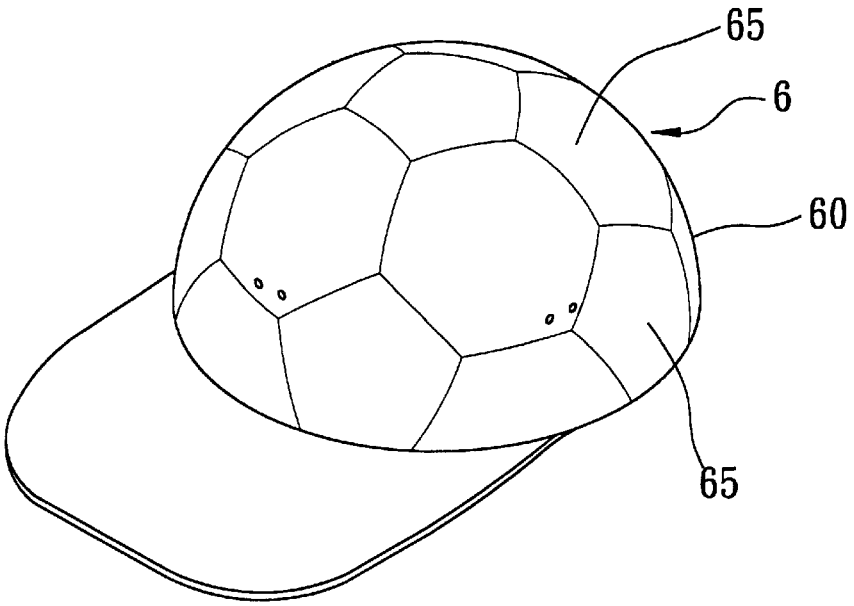
FIG. 7 is a perspective view of a third preferred embodiment of the headwear of the present invention.

Referring to FIG. 7, the third preferred embodiment of the headwear 6 of the present invention is made by a process generally similar to that of the previous embodiments, except that the outer surface of the crown portion 60 is divided into a plurality of hexagonal regions 65 so as to present an image of a soccer ball.

Figure 8:
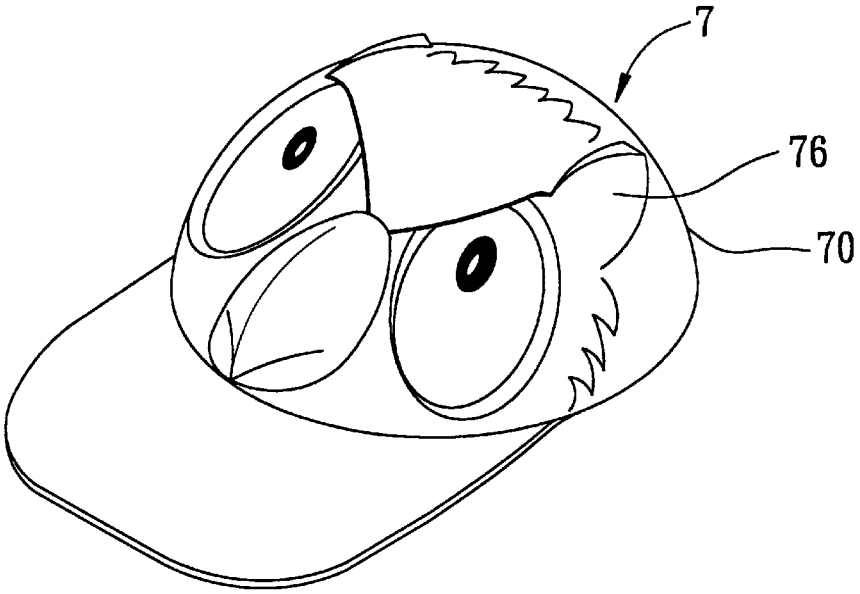
FIG. 8 is a perspective view of a fourth preferred embodiment of the headwear of the present invention.

Referring to FIG. 8, the fourth preferred embodiment of the headwear 7 of the present invention is made by a process generally similar to that of the previous embodiments, except that a decorative member 76, in the form of the face of a cartoon character, is formed integrally on the outer surface of the crown portion 70 during molding of the crown portion 70. The decorative member 76 is colored by printing directly on the molded body.

Figure 9:
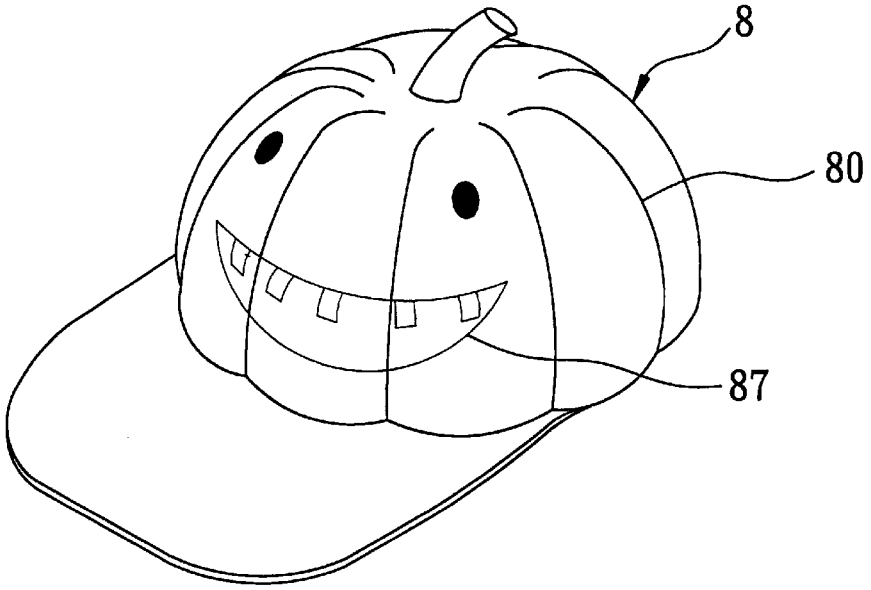
FIG. 9 is a perspective view of a fifth preferred embodiment of the headwear of the present invention.

Referring to FIG. 9, the fifth preferred embodiment of the headwear 8 of the present invention is made by a process generally similar to that of the previous embodiments, except that the crown portion 80 is formed to have a shape simulating a part of a pumpkin. The outer surface of the crown portion 80 is provided with a pattern 87, in the form of a face, by printing directly on the molded body.

Figure 10:
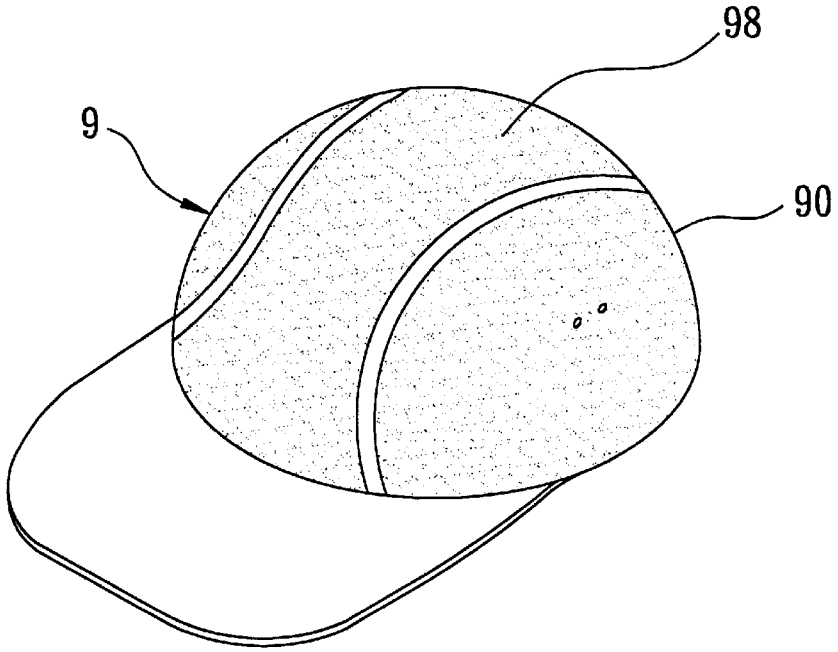
FIG. 10 is a perspective view of a sixth preferred embodiment of the headwear of the present invention.

Referring to FIG. 10, the sixth preferred embodiment of the headwear 9 of the present invention is formed by a process similar to that of the first preferred embodiment, except that the outer surface of the crown portion 90 is provided with a plurality of decorative pieces 98 which are attached directly to the molded body. The decorative pieces 98 may be made of polyurethane, polyvinyl chloride, fabric, yarn, etc, to present an image of a tennis ball.

Figure 11:
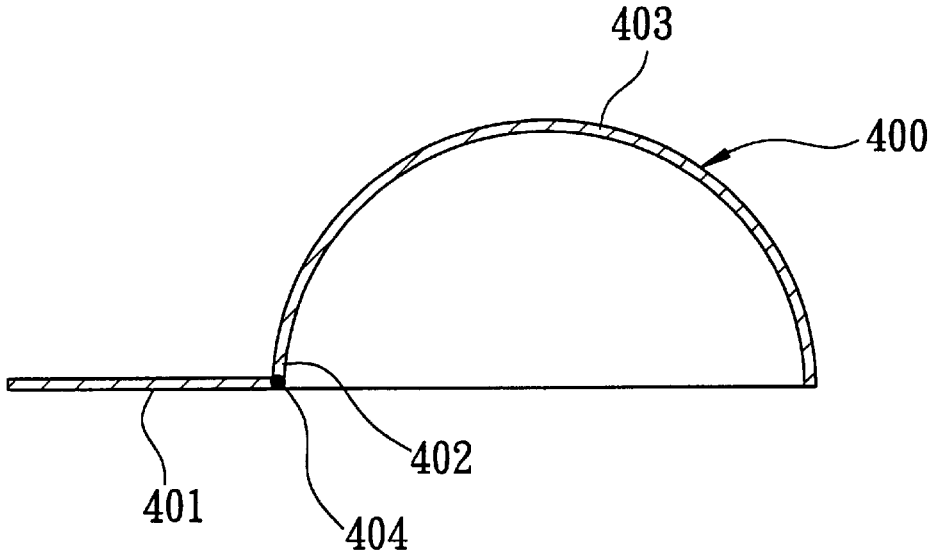
FIG. 11 is a cross-sectional view of a seventh preferred embodiment of the headwear of the present invention.

Referring to FIG. 11, in the seventh preferred embodiment of the headwear 400 of the present invention, the brim 401 is connected to the looped marginal end 402 of the crown portion 403 by means of heat-sealing such that a heat-sealed seam 404 is formed between the brim 401 and the crown portion 403 to interconnect the same.

Figure 12:
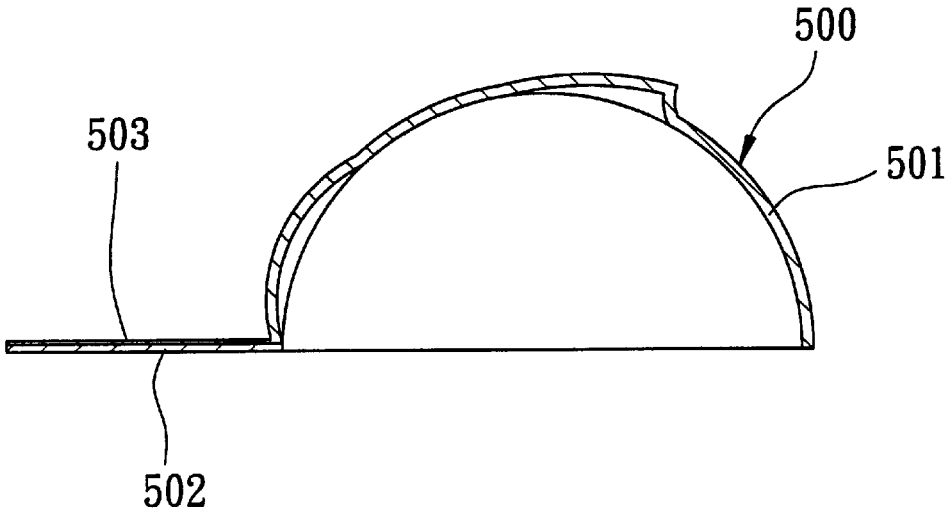
FIG. 12 is a cross-sectional view of an eighth preferred embodiment of the headwear of the present invention.

Referring to FIG. 12, during the manufacture of the headwear 500 of the eighth preferred embodiment of this invention, a stiff plate 502 is disposed in the mold during the molding process such that the resulting molded body has a connecting layer 503 which is formed on the stiff plate 502 and which is connected integrally with the crown portion 501. The stiff plate 502 and the connecting layer 503 cooperatively serve as the brim of the headwear 500.

In each of the above-described embodiments, an adjustment unit (not shown) may be provided on the looped marginal end of the crown portion at a rear side of the headwear in a conventional manner to slightly adjust the size of the crown portion in order to fit the size of the head of the user.

Figure 13:
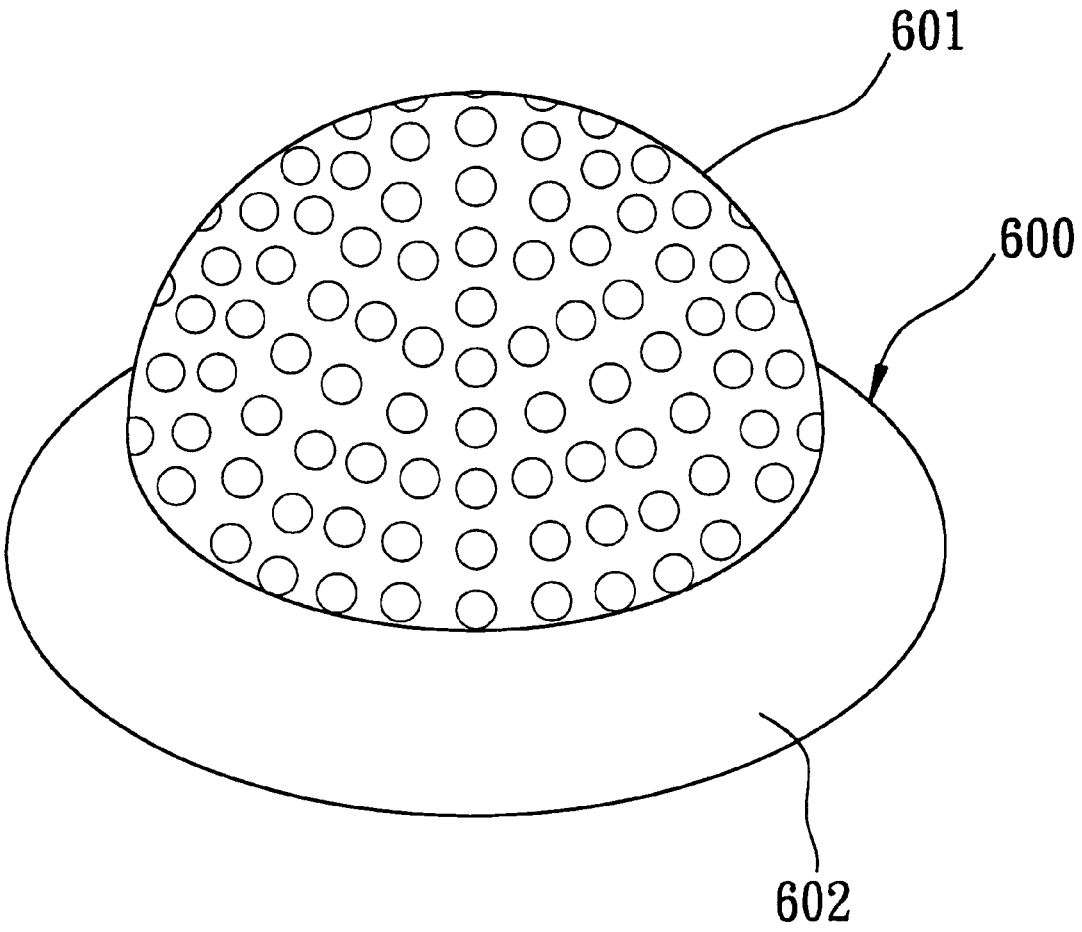
FIG. 13 is a perspective view of a ninth preferred embodiment of the headwear of the present invention.

Referring to FIG. 13, in the ninth preferred embodiment of the headwear 600 of the present invention, the crown portion 601 is molded to have an outer surface simulating the outer surface of a golf ball. The brim 602 is annular in shape, and extends around the looped marginal end of the crown portion 601.

It has thus been shown that the crown portion of the headwear of the present invention is formed as a one-piece molded body and is formed by molding an elastomeric material. The labor-intensive and labor-consuming stitching process during formation of the crown portion of the conventional headwear can be obviated. In addition, the outer surface of the crown portion of the headwear of the present invention can be easily provided with raised or indented pattern parts during molding of the crown portion. A colorful pattern may be provided by printing directly on the molded body. The manufacturing process is significantly simplified as compared to that of the conventional headwear.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A headwear comprising:

a crown portion formed as a one-piece molded body which is flexible while having a measure of rigidity to maintain the shape of said crown portion, said molded body being made of an elastomeric material and having an annular head end and a convex outer surface, said outer surface having a pattern formed directly on said molded body;

a brim connected to said an annular head end;

a stitched seam interconnecting said brim and said an annular head end; and a band sewn to said head end and extending along the length thereof.

2. The headwear as claimed in claim 1, wherein said molded body is perforated to form a plurality of vent holes.

3. The headwear as claimed in claim 1, wherein said molded body has a hemispherical shape.

4. The headwear as claimed in claim 1, wherein said pattern includes raised and/or indented pattern parts.

5. The headwear as claimed in claim 1, wherein said brim is an annular member which extends around said head end.

* * * * *